United States Patent [19]

Masters

[11] Patent Number: 4,520,747

[45] Date of Patent: Jun. 4, 1985

[54] BREAKAWAY KAYAK COCKPIT AND METHOD

[76] Inventor: William E. Masters, 313 Dogwood La., Easley, S.C. 29640

[21] Appl. No.: 584,167

[22] Filed: Feb. 27, 1984

[51] Int. Cl.[3] ..... B63B 35/72

[52] U.S. Cl. ..... 114/347; 114/361

[58] Field of Search ..... 114/347, 348, 351, 361, 114/363

[56] References Cited

U.S. PATENT DOCUMENTS

| | | | |
|---|---|---|---|
| 1,284,968 | 11/1918 | Anderson | 114/361 |
| 2,999,253 | 9/1961 | Lewis | 114/347 |

FOREIGN PATENT DOCUMENTS

| | | | |
|---|---|---|---|
| 504287 | 8/1930 | Fed. Rep. of Germany | 114/347 |
| 536699 | 10/1931 | Fed. Rep. of Germany | 114/361 |
| 14407 | 2/1956 | Fed. Rep. of Germany | 114/347 |
| 2655838 | 5/1978 | Fed. Rep. of Germany | 114/347 |

*Primary Examiner*—Trygve M. Blix
*Assistant Examiner*—Thomas J. Brahan
*Attorney, Agent, or Firm*—Cort Flint

[57] ABSTRACT

A breakaway cockpit for a kayak is disclosed which includes an egress opening (26) formed in a deck (12) of a kayak hull. An egress panel (28) covers the opening. A cockpit rim (16) surrounding the cockpit opening (14) of the cockpit (18) is interrupted so that a boater may escape from the cockpit through the egress opening. A rim (30) of the egress panel (28) and the rim (16) of the cockpit opening from a composite rim about the entire periphery of the cockpit opening. A sealing strip (34) seals the joint between the egress opening and panel against the entry of water and also assists in retaining the egress panel in place. The egress panel may be popped out by manual force in the event of an emergency so that the boater may escape the cockpit.

19 Claims, 6 Drawing Figures

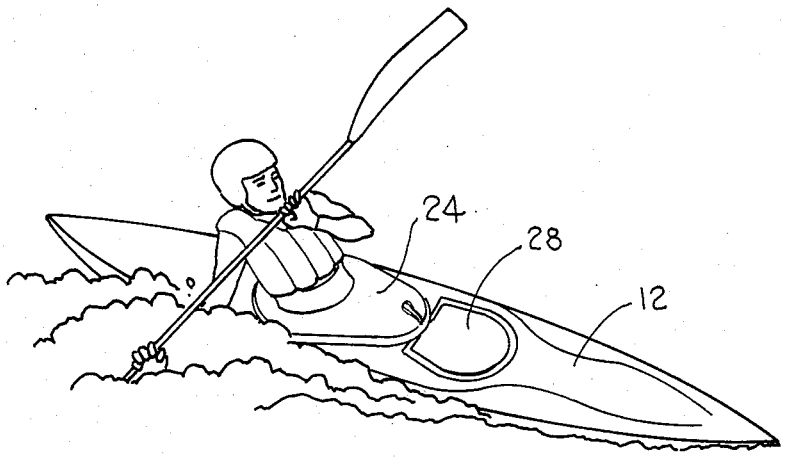
Fig. 1.
Fig. 3.
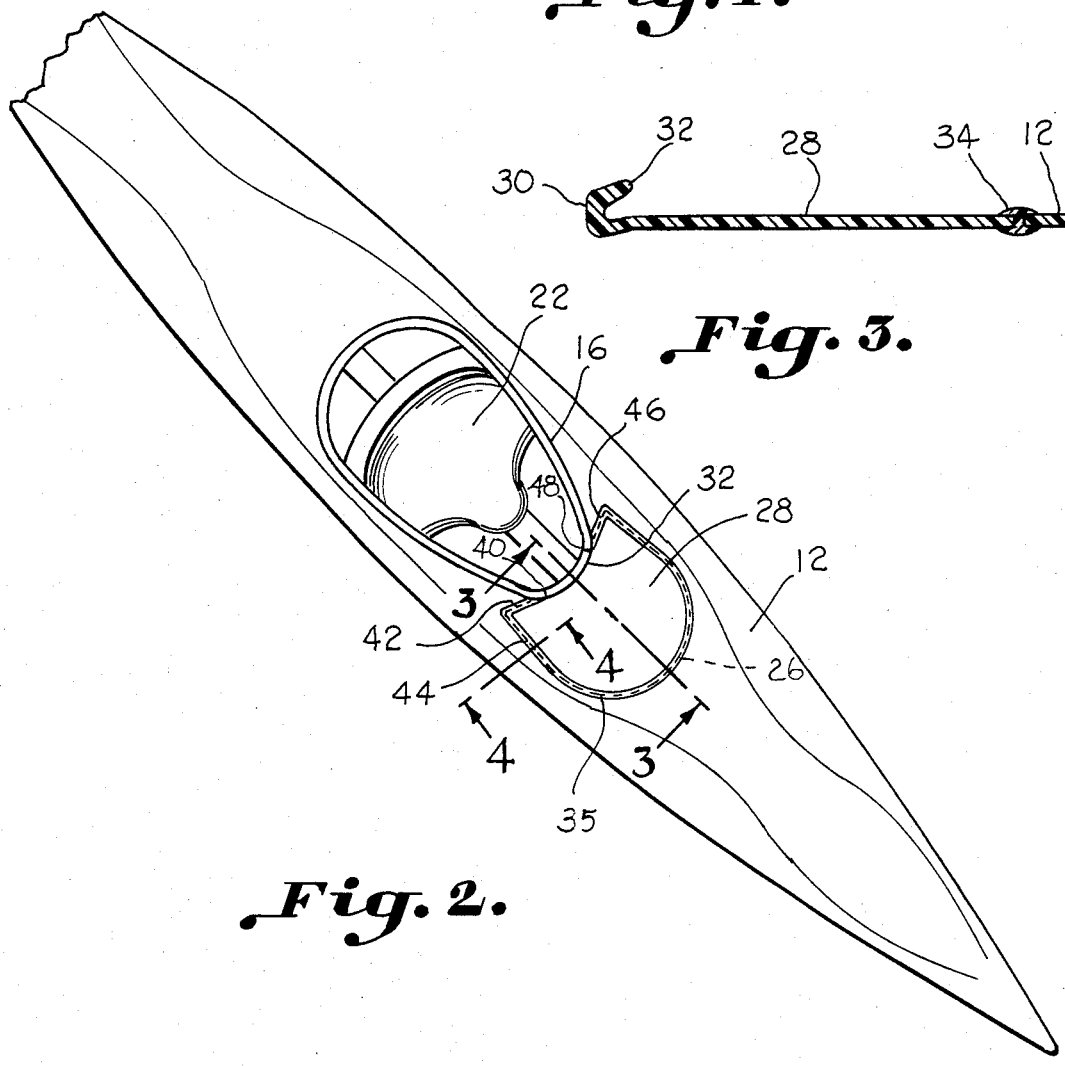
Fig. 2.

BREAKAWAY KAYAK COCKPIT AND METHOD

BACKGROUND OF THE INVENTION

The invention relates to the emergency escape from a boat and, more particularly, to the emergency escape of a boater from a kayak-type boat wherein the boater is seated in a cockpit of the boat and surrounded by a small cockpit opening.

Typically kayaks and other small boats with cockpit openings have been provided where the boater is seated in a cockpit of the boat defined by a lower hull and upper deck. The cockpit opening may range from an opening just large enough to permit the boater to enter the boat and sit to a larger opening wherein the ingress and egress of the boater is not restricted. Even in larger opening cockpits, the opening is often covered by canvas or other material to prevent the entry of water into the interior of the boat.

In a kayak, the boater is typically wearing a spray skirt which fits about his waist and is elastically secured to a rim of the cockpit opening which encircles the periphery of the opening. This prevents the entry of water into the boat.

In either of the above cases, in certain emergency situations the boater must be able to escape the boat quickly and safely. Due to the small cockpit in a kayak this problem is increased. Kayaks traveling swiftly down water with fast currents have been known to strike rocks and other abutments such as bridge columns. The boater can slide forward on impact if his feet slip off of the foot braces. In a kayak the boater can become jammed into the forward section of the kayak making it difficult for him to escape from the relatively small cockpit opening. This is particularly a problem where the boater is wearing a spray skirt fitted around the cockpit opening.

Accordingly, provision of a cockpit for a kayak and the like boats from which a boater may escape during an emergency is a problem to which considerable attention need be given.

Accordingly, an important object of the present invention is to provide an egress opening for a boat having a small cockpit opening from which the boater may reliably escape during an emergency.

Still another important object of the present invention is to provide a breakaway cockpit opening for a kayak constructed from a flexible fin material wherein the boater may break away a portion of the deck of the kayak and escape the small diameter cockpit opening during emergencies.

Still another important object is to provide a breakaway cockpit for a kayak which is waterproof.

SUMMARY OF THE INVENTION

The above objectives are accomplished according to the present invention by providing in a cockpit having a lower hull and an upper deck constructed from a flexible skin material by providing a removable panel forward of the cockpit opening which is sealed in place and yet can be kicked open by the boater seated in the cockpit. The panel is generally removable and is retained and sealed in place by a sealing strip which retains the waterproofness of the deck and allows the panel to pop out during an emergency. The panel includes a portion of the rim which encircles the cockpit opening. A spray skirt formed by the boater assists in retaining the panel in place when fitted about the rim of the cockpit opening and the egress panel. In an alternate embodiment, the egress panel is formed by cutting out a portion of the deck of the kayak forward of the cockpit opening. A portion of the deck is left uncut to provide a flexible hinge so that the egress panel is not lost when it is opened.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a perspective view of a boater seated in a cockpit of a kayak having a breakaway cockpit constructed according to the present invention;

FIG. 2 is a top plan view of a kayak incorporating a breakaway cockpit according to the invention which includes a breakaway egress panel;

FIG. 3 is a sectional view taken along line 3—3 of FIG. 2;

DESCRIPTION OF A PREFERRED EMBODIMENT

Figure 4:
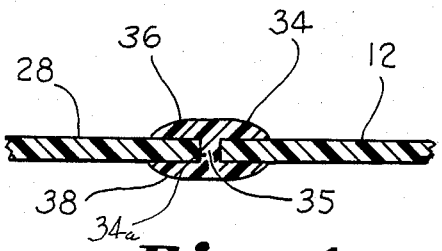
FIG. 4 is a sectional view taken along line 4—4 of FIG. 2.

The invention relates to a breakaway cockpit for a boat which enables the boater to be released from the cockpit should the boat impact an object and the boater become wedged within the hull of the boat.

Referring now in more detail to the drawings, a kayak having a hull 10 which includes an upper deck 12 in which a cockpit opening 14 is formed with a cockpit rim 16 formed about the periphery of the cockpit opening 14. The cockpit opening permits entrance into the cockpit 18 of the kayak in which a boater 20 sits on a cockpit seat 22. A conventional kayak is shown in U.S. Pat. No. 4,227,272.

Typically, the hull 10 is formed of a flexible skin material such as a cross-length polyethylene material. The hull is typically made by utilizing conventional rotational molding techniques or by utilizing vacuum molding techniques to provide a continuous enclosed hull with the central cockpit opening 14 formed in the deck of the hull. Fiberglass and other materials may be utilized.

In the normal course of whitewater boating, a spray skirt 24 is normally worn about the waist of the boater. The spray skirt 24 includes some means for fastening the spray skirt about the rim 16 of the cockpit. Normally an elastic band is included in the periphery of the spray skirt which snaps over and about the cockpit rim 16. This prevents entry of water into the kayak under rough water conditions, for example, as encountered in whitewater boating.

In accordance with the present invention, a breakaway cockpit and method therefor is disclosed which includes an egress opening 26 formed forward of the cockpit opening 14. The egress opening is cut in the upper deck 12 of the boat and includes an interruption 26*a* in the cockpit rim 16 so that the boater may escape from the cockpit through the rim and egress opening. An egress panel 28 is carried in the egress opening to cover the opening. The egress panel includes an upstanding rim 30 having an outwardly extending lip 32 which corresponds to the configuration of the cockpit rim 16. The cockpit rim 16 and panel rim 30 form a composite rim about the entire cockpit opening. The rim 30 and lip 32 of the egress panel 28 form the part of the rim 16 of the cockpit at the forward end of the cockpit.

A sealing means in the form of a pliable neoprene or rubber seal 34 is carried in the joint between the egress panel 28 and the deck 12. The sealing strip 34 has a generally H-shaped cross-section which seals the upper surface of the deck and egress panel to prevent the entry of water and make the same waterproof. The "H" section can be a homogeneous semiflex material or may be made of a dual material where the flange on top is rigid and the flange on the bottom is flexible. While sealing the upper deck to make it waterproof, the sealing strip 34 also retains the egress panel in place while permitting the panel to be popped out under sufficient manual force by the boater. The knees or hands of the boater may be used in this case to pop out the egress panel. There is a joint 35 between the edges of egress panel and egress opening which the stem 34*a* of the sealing strip seals.

The upper flange 36 of the sealing strip seals against water while the lower flange 38 provides a retention means which retains the seal and panel in place.

According to the method, the egress opening 26 and panel 28 are formed by a cut in the upper deck which includes a cut 40 formed in the cockpit rim and angled edge 42 extending from the cut 40 which terminates in an acute angle with a cut 44 which extends on around the deck and terminates at a second angular edge 46. There is a corresponding acute angle between the cut 46 and periphery cut 44. The angular edge cut 46 terminates in a second cockpit rim cut 48.

The sealing strip 34 may be molded to conform to the shape of the cut-out thus described or it may be made in three pieces such that is eals the cuts so described except for the cockpit rim cut.

With the spray skirt 24 fitted about the composite rim of rims 16 and 30 of the cockpit and egress panel, the egress panel is held firmly in place. This in addition to the sealing strip insures that the egress panel will not be removed unless by manual force of the boater during an emergency.

Due to the attachment of the spray skirt about the rim of which the egress panel rim 32 is a part, there is some pulling force exerted on the egress panel 28 when the spray skirt is fitted about the rim. To insure that the spray skirt forces do not dislodge the panel as would result in accidental popping out of the panel, the cuts 40, 48, 42, and 46 are made at an angle so that the force of the spray skirt on the panel pulls it against the opposing edges of the deck and cockpit rim portions to effectively resist the pull of the spray skirt on the panel.

Figure 5:
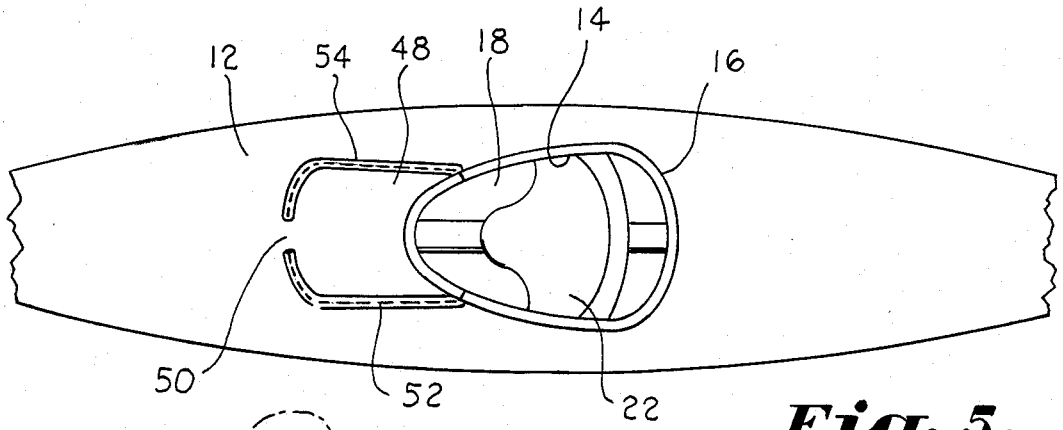
FIG. 5 is a top plan view of a kayak having a breakaway cockpit with an alternate form of an emergency egress panel.

Referring now to FIG. 5, an alternate embodiment of the invention is illustrated wherein a portion 50 of the upper deck 12 remains uncut so that a plastic hinge is formed thereat. This provides retention of the panel in place after pop-out and also resists the above described occurrence and accidental dislodgement.

Figure 6:
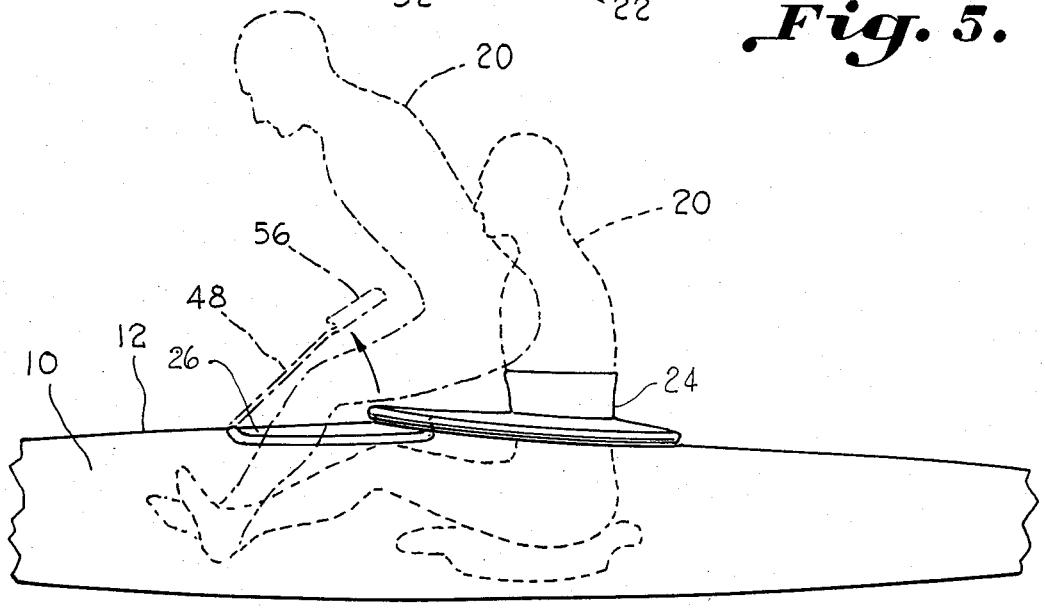
FIG. 6 is a side elevation illustrating a breakaway cockpit constructed according to the invention with the boater breaking out of the cockpit.

In the case of FIG. 5, the egress panel may take on a different shape wherein side cuts 52 and 54 are formed as initiating at the plastic hinge 50 and curving around rearwardly to the cockpit rim where the cockpit rim is cut to define a panel rim 56. The panel rim breaks the periphery of the cockpit rim so that the boater will have unobstructed egress with the panel lifted up to the position shown in dotted lines in FIG. 6.

Thus, it can be seen that an advantageous construction can be had according to the invention for an emergency egress panel which provides a breakaway cockpit for the emergency escape of a boater which is seated in the cockpit of the boat. Should the kayak impact an object such as a rock or pylon in the river, while undergoing rapid speed, the boater will not become trapped in the hull of the kayak but may release himself by popping open the egress panel 28, 48, to allow quick escape from the kayak.

It will be understood, of course, that while the form of the invention herein shown and described constitutes a preferred embodiment of the invention, it is not intended to illustrate all possible form of the invention. It will be understood that the words used are words of description rather than of limitation and that various changes may be made without departing from the spirit and scope of the invention herein disclosed.

What is claimed is:

1. In a boat having an enclosed hull with an upper deck defining a hull interior, a cockpit opening formed in said deck through which a boater is seated in a cockpit of said hull interior, a rim around said cockpit opening having an outwardly extending lip about which a spray skirt worn by said boater is fitted to cover said cockpit opening for waterproofness, a breakaway cockpit permitting emergency escape from said cockpit comprising:

an egress opening formed in said deck afront of said cockpit opening facilitating unobstructed escape of said boater through said egress opening;

a removable egress panel carried in said egress opening forward of said cockpit opening;

sealing means retaining said egress panel in flush relationship with said deck and sealing said deck against the entry of water;

said egress panel having a rim forming a part of said cockpit rim when in placement therewith to provide a composite rim around the entire periphery of said cockpit opening;

angled edges formed on said egress panel at rear opposing portions bearing against said sealing means and complementary edges of said egress opening to resist outward movement of said egress panel under the force of said spray skirt attached about said composite rim of said egress panel rim and cockpit rim; and said egress panel dislodging from said egress opening by manual force of said boater so that said egress panel and seal are released and said egress panel pops out of said deck for emergency escape from the cockpit.

2. The device of claim 1 wherein said egress opening is defined by a cut formed in the deck of said hull through a forward portion of said cockpit rim defining an egress space in said cockpit rim, said sealing means including a sealing strip around said entire cut interposed between said edges of said egress opening and said egress panel.

3. The apparatus of claim 2 wherein said sealing strip includes an upper sealing flange bridging a joint between said egress opening and said egress panel and overlying said joint to waterproof said deck against the entry of water into said hull interior, a stem interposed between said edges of said egress opening and said egress panel, and a lower retention means carried by said stem for retaining said egress panel in place.

4. The device of claim 1 wherein said egress panel includes tapering sides and angled edges integral with said tapering sides extending inwardly towards said cockpit opening and cutting across said cockpit rim to define said rim of said egress panel.

5. The device of claim 4 wherein said angled edges make an acute angle with said tapering sides of said panel.

6. The device of claim 1 wherein said egress panel is a separate panel which dislodges and separates completely from said deck of said kayak.

7. In an boat having an enclosed hull with an upper deck and an interior space within said hull, a cockpit opening formed in said deck through which a boater is seated in a cockpit within said interior space, a spray skirt rim around the cockpit opening having an upstanding neck and an outwardly extending lip about which a spray skirt worn by the boater is fitted to cover the cockpit opening for waterproofness, a breakaway cockpit permitting emergency escape from said cockpit comprising:

an egress opening formed in front of said cockpit opening;

a removable egress panel carried in said egress opening forward of said cockpit opening;

a joint defined between edges of said egress opening and said egress panel;

means for sealing said joint to prevent entry of water into said interior space of said hull;

means retaining said egress panel in place within said egress opening in generally flush relation with said deck of said hull;

an interruption formed in said cockpit rim defining an egress space so that the boater may move through said cockpit rim and said egress opening for escape from said cockpit; and said retention means being overcome by manual force of the boater to dislodge said egress panel from said deck and permit egress from said cockpit of said boat for emergency escape.

8. The device of claim 7 wherein said means for sealing said joint in said deck of said hull includes a sealing strip having upper flanges which overlie said deck and egress panel, a stem integral with said flange which is sandwiched between edges of said egress opening and said egress panel.

9. The device of claim 8 wherein said retention means includes a lower flange means extending outwardly from both sides of said stem and bearing against the underneath side of said deck and said egress panel.

10. The device of claim 7 wherein said egress panel includes a rim defined by an upstanding neck and an outwardly extending rim which correspond in shape to said cockpit rim so that said egress panel rim forms a composite part of said cockpit rim when said egress panel is in place.

11. The device of claim 7 wherein said egress panel includes angled edges at a rear portion thereof adjacent said cockpit opening which bear against said sealing means and opposing corresponding edges of said deck to maintain said panel in place when pulled by said spray skirt fitted about the rim of said egress panel.

12. The device of claim 7 including a hinge at the forward end of said egress panel remote from said cockpit opening which permits upward pivotal movement of said egress panel about said hinge.

13. In a boat having an enclosed hull defining an interior space and an upper deck, a cockpit opening formed in said deck in which a boater is seated in a cockpit within said interior space, a rim around said cockpit opening having an upstanding neck and an outwardly extending lip about which a spray skirt worn by the boater is fitted to cover the cockpit opening for waterproofness, breakaway cockpit permitting emergency escape from the cockpit comprising:

an egress opening formed in said deck forward of said cockpit opening permitting escape of the boater from the cockpit;

a removable egress panel carried in said egress opening forward of said cockpit opening in flush relation with said deck;

a joint defined between the edges of said egress opening and said egress panel when in place;

sealing means for sealing said joint to prevent the entry of water into said interior space of the hull;

retention means for retaining said egress panel in place in said generally flush relationship with said deck while permitting dislodgement of said egress panel during an emergency;

said egress panel having a rim which includes an upstanding neck and outwardly extending lip corresponding to the shape of said cockpit rim and forming a total composite rim about the entire periphery of said cockpit opening when said egress panel is in place;

an elastic hinge formed between said deck and said egress panel at the forward end of said egress panel which facilitates pivotal movement of said egress panel when dislodged from said deck and egress opening is uncovered; and said egress panel being dislodged from said deck under the manual force of the boater to permit escape of the boater from said cockpit through said rim and egress opening during an emergency escape.

14. The device of claim 13 wherein said egress panel includes rear angled edges which terminate adjacent said egress panel rim, and said sealing means includes a stem fitted in said joint between said angled edges and the corresponding opposing edges of said egress opening formed in said deck.

15. A method of providing emergency escape from a boat of the type having an enclosed hull with an upper deck defining an interior space, a cockpit opening formed in said deck through which a boater is seated in a cockpit of said boat within said interior space, a rim around said cockpit opening about which a spray skirt worn by the boater is fitted to cover said cockpit opening for waterproofness, said method comprising:

forming an egress opening in the deck of said hull in front of said cockpit opening through which a boater may escape from the interior space of said hull;

forming an interruption in said rim of said cockpit opening so that said boater may escape from the cockpit through said egress opening;

providing a removable egress panel which fits within said egress opening to define a narrow joint between edges of said opening and said egress panel;

providing means for sealing said joint against the entry of water;

providing means for retaining said egress panel in place while permitting said egress panel to be dislodged under the manual force of said boater so that said boater may escape through said interrupted rim and egress space; and providing a rim on said egress panel which forms a composite rim with said cockpit rim so that said spray skirt may be fastened about said cockpit rim and egress panel rim as a composite rim during boating.

16. The method of claim 15 which includes forming a cut through said cockpit rim which continues around said deck and cuts said cockpit rim at a point spaced from said first cut of said cockpit rim.

17. The method of claim 15 including providing a hinge at the forward end of said egress panel remote from said cockpit opening by which said egress panel may be opened forward for escape from said cockpit.

18. The method of claim 17 wherein said hinge is formed by leaving a portion of material which is not cut in the deck of said hull to provide a plastic hinge.

19. The method of claim 15 including forming two angled cuts across said cockpit rim at a portion of said egress opening adjacent said cockpit rim, and forming rear edges of said egress panel corresponding to said angle edges of said cockpit opening so that said edges bear against one another to retain said egress panel in place.

* * * * *